United States Patent [19]

Werner

[11] 4,038,769

[45] Aug. 2, 1977

[54] PORTABLE SIGN HOLDER

[76] Inventor: William A. Werner, 1022 Koala, Salem, Oreg. 97303

[21] Appl. No.: 613,303

[22] Filed: Sept. 15, 1975

[51] Int. Cl.[2] ..... G09F 7/18

[52] U.S. Cl. ..... 40/125 H; 40/125 N; 40/129 R

[58] Field of Search ..... 40/125 H, 125 N, 138, 40/129 R, 145 A; 116/63 P, 63 R

[56] References Cited

U.S. PATENT DOCUMENTS

| | | | |
|---|---|---|---|
| 1,863,756 | 6/1932 | Lufkin | 116/63 P |
| 2,863,238 | 12/1958 | Keech | 40/125 H |
| 3,256,853 | 6/1966 | Underwood | 116/63 P |
| 3,591,116 | 7/1971 | Dalum | 40/125 H |
| 3,662,482 | 5/1972 | Sarkisian | 40/125 H |

*Primary Examiner*—John F. Pitrelli

*Attorney, Agent, or Firm*—Kolisch, Hartwell, Dickinson & Stuart

[57] ABSTRACT

A portable sign holder including a generally upright sign support and a collapsible base to which the sign support is connected. The base includes a pair of elongate leg members pivotally mounted for swinging about horizontal axes between support positions extending outwardly to opposite sides of the sign support and collapsed positions extending upwardly adjacent opposite faces of the sign support. Releasable locking devices hold the legs in their support positions, extending at low angles from the horizontal whereby their outer ends contact the ground with their inner ends slightly elevated. The sign support is connected to the base by a resilient mounting which permits movement of the sign support relative to the base upon a force being applied thereto.

11 Claims, 8 Drawing Figures

PORTABLE SIGN HOLDER

BACKGROUND AND SUMMARY OF THE INVENTION

This invention relates to a portable sign holder, and more particularly to such a portable sign holder in which support legs therefor are swingable about substantially horizontal pivot axes between outwardly extending support positions and upwardly extending collapsed positions, with releasable locking means for holding them in selected positions.

Highway safety signs used during construction periods and various display signs often must be moved, either for storage or transportation. For this reason, it is desirable to have a portable sign which may be collapsed for transport and storage, but which has extendible support legs which provide a stable base for the sign.

In the past, various attempts have been made to design portable sign holders, which when set up in operative position will withstand exterior forces, such as wind loads and hitting by equipment working therearound without being knocked over and made unreadable in their laid-over position. Such prior devices have not been totally successful however.

A general object of the present invention is to provide a novel portable sign holder which is easily collapsed for transport and storage, yet which when extended to its operative position provides a stable support for a sign.

A more specific object of the present invention is to provide such a novel sign holder including a generally upright sign support and a pair of legs pivotally mounted in the apparatus in such a manner that when collapsed, they extend upwardly adjacent opposite faces of the sign holder to provide a degree of protection for a sign held thereon during transportation and storage, and upon being swung to their support positions, extend downwardly at a low angle, whereby their outer, ground-engaging ends are lower than their inner pivotally mounted ends. With the legs thus being downwardly inclined generally only their outer ends are in contact with the supporting surface and thus provide a more stable sign holder to withstand being knocked over by wind or other external forces.

Yet another object is to provide such a novel sign holder having collapsible, pivotally connected legs in which the sign support is connected to the base through a resilient mounting generally holding the sign support in an upright position, but being yieldable to permit movement of the sign holder and a sign held thereon to a somewhat lower position upon application of an external force, and causing the sign support and sign mounted thereon to return to a generally upright position when the external force is removed.

Yet another object of the invention is to provide novel releasable locking means for holding the support legs in selected adjusted positions.

DRAWINGS

These and other objects and advantages will become more fully apparent as the following description is read in conjunction with the drawings wherein.

DETAILED DESCRIPTION OF PREFERRED EMBODIMENTS OF THE INVENTION

Figure 1:
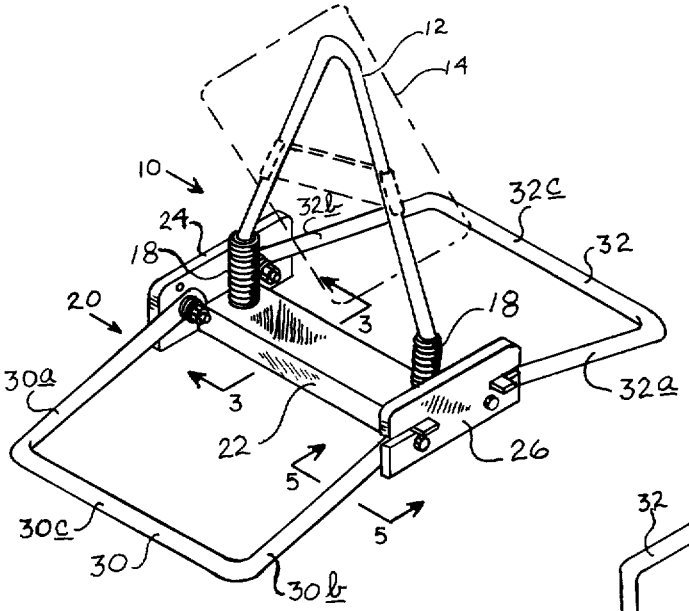
FIG. 1 is a perspective view of a portable sign holder constructed according to an embodiment of the invention with the support legs thereon extended.
Figure 2:
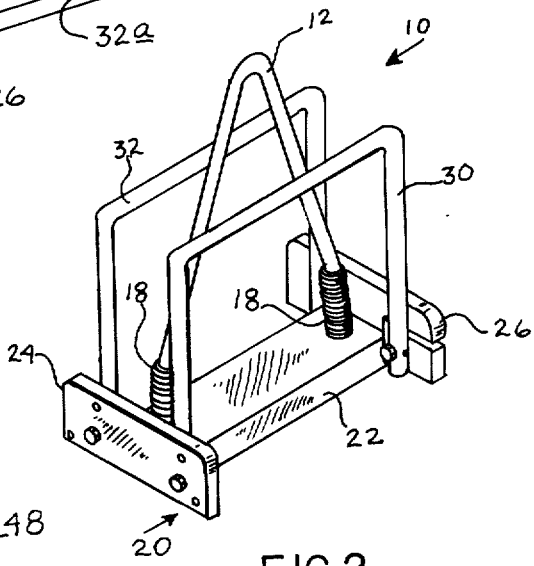
FIG. 2 is a perspective view of the sign holder of FIG. 1 with the support legs collapsed.

Referring to FIGS. 1 and 2, at 10 is indicated generally a portable sign holder constructed according to an embodiment of the invention. The holder includes a generally upright, substantially U-shaped, or V-shaped, tubular sign support 12 on which a sign, such as that indicated in phantom outline at 14, may be mounted.

The sign support 12 is connected through a pair of upright coil springs 18, also referred to herein as resilient mounting means, to a base indicated generally at 20.

The base includes an elongate channel member 22 to opposite ends of which are secured, as by welding, upright plate brackets 24, 26. Brackets 24, 26 with channel 22, form what is referred to herein as an integral base member. Springs 18 are secured, as by welding, at their lower set of ends adjacent opposite ends of channel 22, and at their upper set of ends to sign support 12.

A pair of substantially U-shaped leg members 30, 32 are pivotally connected to brackets 24, 26 as will be described below. Each of leg members 30, 32 has opposed, elongate leg portions **30*a*, 30*b*, 32*a*, 32*b*, respectively, and cross member portions 30*c*, 32*c*** extending between and interconnecting such leg portions.

Figure 4:
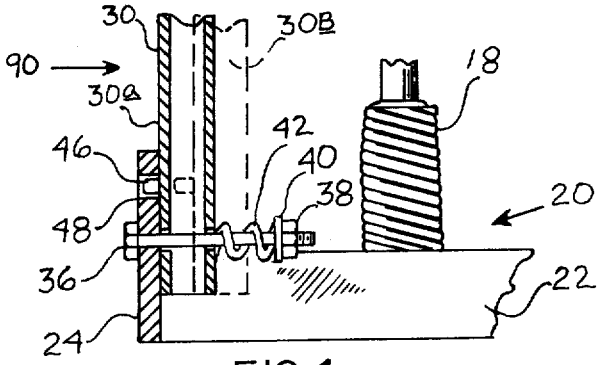
FIG. 4 is an enlarged cross-sectional view taken generally along the line 4—4 in FIG. 3 illustrating a support leg in a raised, or collapsed, position.

The inner, or unconnected, ends of member 30 are pivotally connected to brackets 24, 26 in a manner similar to the pivotal connection between the inner ends of the leg portions of leg member 32. Thus, the pivot connection for only one such leg member will be described in detail. Referring first to FIG. 4, the inner end of leg portion **30*a* is pivotally connected to bracket 24 by an elongate bolt, or pivot pin, 36 which extends through accommodating aligned bores in bracket 24 and leg portion 30*a*. A nut 38 with a washer 40 thereagainst confines a compression spring 42 between leg portion 30*a* and the end of bolt 36. The spring yieldably biases leg portion 30*a* toward bracket 24**.

As is seen in FIG. 4, a projection 46 is secured to the side of leg portion 48 facing bracket 24 and extends outwardly therefrom.

Figure 3:
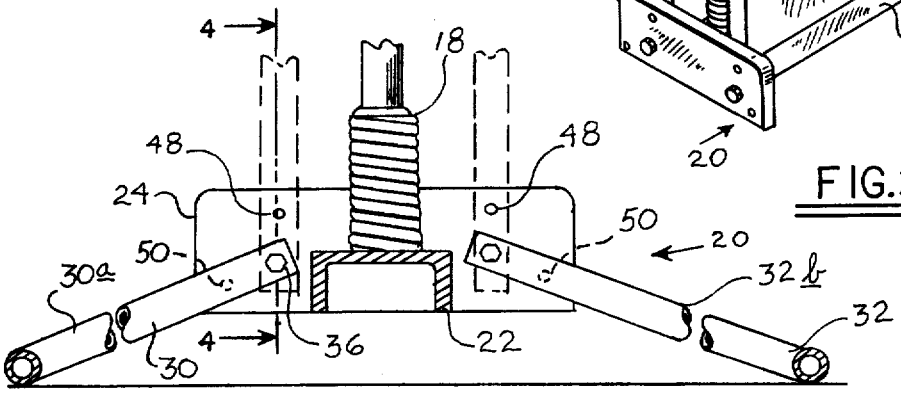
FIG. 3 is an enlarged elevation view of a portion of the apparatus taken generally along the line 3—3 in FIG. 1.

A pair of bores, or depressions, 48, 50 in bracket 24 are positioned to receive projection 46 when leg member 30 is swung either to its support position as illustrated in solid outline in FIGS. 1 and 3, or to its collapsed position, as illustrated in dot-dashed outline in FIG. 3 and in solid lines in FIGS. 2 and 4. As is best seen in FIG. 3, bores 48, 50 are spaced radially outwardly from the pivot connection provided by bolt 36 a distance substantially equal to the distance from the pivot axis to projection 46. Further, bores 48, 50 are spaced apart greater than 90° relative to pivot bolt 36, with bore 48 being substantially directly above pivot bolt 36 and bore 50 being at a slightly lower elevation.

With leg portion 30*a* in a raised, or collapsed, position, projection 46 is aligned with bore 48 and is forced into bore 48 by the biasing force of spring 42 urging leg portion 30*a* toward bracket 24. By manually forcing leg portion 30*a* inwardly to the position illustrated in dot-dashed outline at 30B in FIG. 4, projection 46 is released from the bracket and may be swung downwardly until it is aligned with bore 50, at which time the leg may be released and spring 42 will urge the leg portion toward the bracket with projection 46 entering bore 50 to lock the leg in its support position extending at a low angle relative to the horizontal downwardly from pivot bolt 36, whereby its outer ground-engaging end is at a lower elevation than its inner end.

Figure 5:
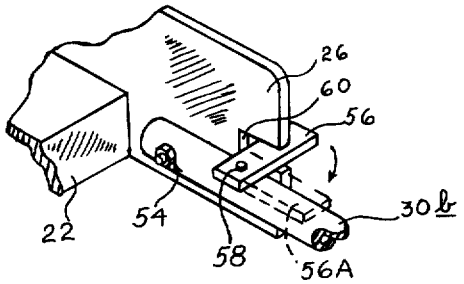
FIG. 5 is a perspective view of a locking device for holding a support leg in an extended position.

Referring to FIG. 5, the inner, or unconnected, end of leg portion 30*b* is pivotally connected to bracket 36 through a bolt and nut combination 54 which provides a substantially horizontal pivot axis for leg portion 30*b*. An elongate locking bar 56 is pivotally connected at 58 to leg portion 30*b* for swinging between a locking position as illustrated in solid in FIG. 5 and an unlocked position as illustrated in dot-dashed outline at 56A.

A slot 60 formed in of bracket 26 is positioned to receive locking bar 56 and hold leg portion 30*b* in its support position during operation. Swinging of bar 56 to its unlocked position, as illustrated in dot-dashed outline, permits the leg portion to be swung upwardly to its collapsed position.

Explaining the operation of the device described and referring to FIGS. 1–5, with the legs of the sign holder in their upright, collapsed position as illustrated in FIG. 2, they are held in this position by the projections on the legs being biased into bores 48 in the brackets by springs 42. Brackets 24, 26 are long enough to support the sign holder in a generally upright position when collapsed if no undue force is applied to the sign holder. To set up the sign for use, force is applied to leg potions 30*a*, 32*a* in the direction of arrow 90 in FIG. 4 to shift the leg portions inwardly to the position illustrated in dot-dashed outline in FIG. 4 to release the locking projection whereby the legs can be swung downwardly to the positions illustrated in FIG. 3 with projections 46 on the legs then entering bores 50 to lock them in this position. Locking bar 56 (see FIG. 5) then is swung to its locking position in notch 60 to lock the opposite side of the leg member in its support position. With the legs in their support positions, they extend downwardly at a low angle relative to the horizontal, with their outer, ground-engaging ends lower than their inner pivoted ends. This provides a more stable base to support a sign, especially on rough terrain, than would a totally flat base.

With the sign thus set up in the position illustrated in FIG. 1, a sign 14 mounted on the holder is visible. Should a wind, or other external force act against the sign, springs 18 allow the sign and sign support 12 to lay over somewhat without tipping the frame. Upon release of the external force, the sign support 12 and sign spring back to the generally upright position illustrated in FIG. 1.

Figure 6:
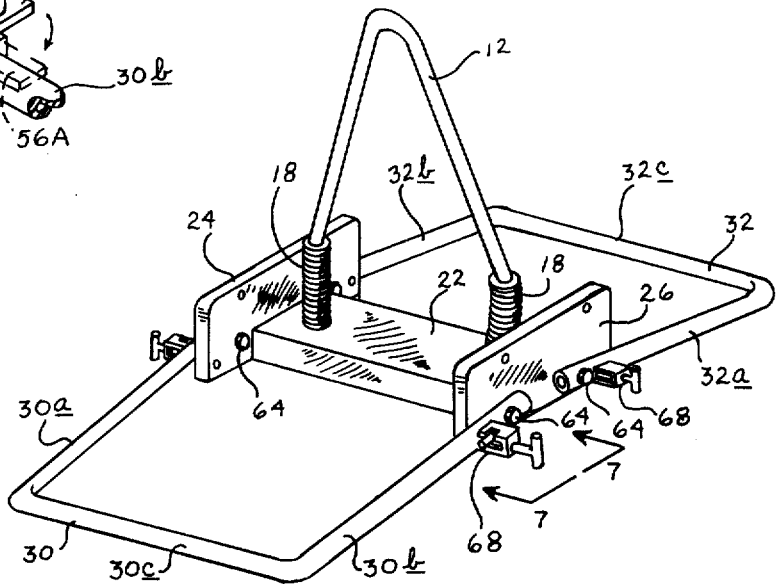
FIG. 6 is a perspective view of a modified embodiment of the sign holder of the invention.
Figure 7:
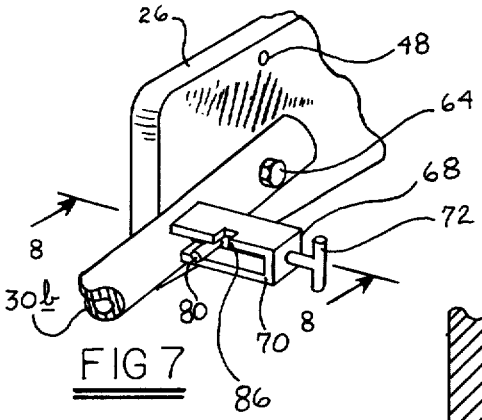
FIG. 7 is an enlarged perspective view of leg locking means in the modified embodiment of the invention.
Figure 8:
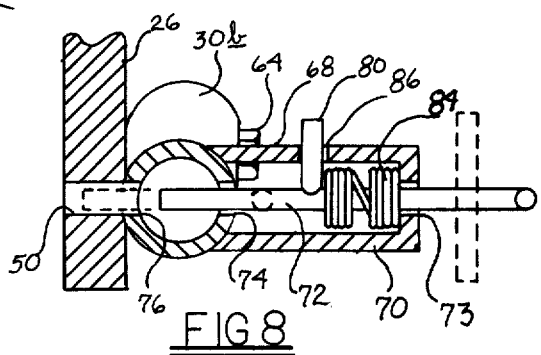
FIG. 8 is a cross-sectional view taken generally along the line 8—8 in FIG. 7.

A second embodiment of the invention illustrated in FIGS. 6–8. As is seen in FIG. 6, leg portions 30*a*, 30*b*, 32*a*, 32*b*, are pivotally connected to the outer sides of brackets 24, 26 by bolt and nut combinations 64. Bores 48, 50 are formed in brackets 24, 26 and are positioned similar to those previously described in the first embodiment of the invention. In this second embodiment of the invention however, different locking means indicated generally at 68 is used to lock the leg members in selected, adjusted positions.

Describing a locking device 68, it includes a substantially U-shaped lug 70 secured, as by welding, to the outer side of a leg portion of a support leg. An elongate T-shaped locking rod, or pin, 72 extends through a bore 73 in the outer end of lug 70 and through aligned bores 74, 76 in leg portion 30*b*. Bores 74, 76 are substantially aligned with bore 50 in bracket 26 when the leg member is in its support position, and are aligned with bore 48 when the leg member is in its collapsed position.

A post 80 is secured, as by welding, to a midportion of rod 72 and projects normally outwardly therefrom. A compression spring 84 surrounding a portion of rod 72 is confined between post 80 and the outer end of lug 70 so that it yieldably biases rod 72 toward bracket 26. A notch 86 in lug 70 is provided to hold post 80 and rod 72 in a retracted position as illustrated in FIGS. 7 and 8. On rotation of rod 72 in one direction, post 80 moves out of notch 86 and spring 84 urges rod 72 to pass through bore 76 into either of bores 48 or 50 with which the rod is then aligned to lock the leg member in either its support or collapsed position.

The modified sign holder illustrated in FIG. 6 works in substantially the same way as that previously described for the sign holder of FIGS. 1–5, except that the legs are held in their support positions by rods 72 extending through bores 50 in the brackets. To release the leg members from their support positions, the rods 72 are retracted to the positions illustrated in FIGS. 7 and 8 and rotated to place pins 80 in notches 86 to hold them in their retracted positions. With the rods in their retracted positions, the legs may be swung upwardly to their collapsed position adjacent opposite faces of sign support 12. Rotation of rods 72 to the position illustrated in dot-dash outline in FIG. 8 releases the rods and allows them to extend through bores 48 to lock the leg members in their upright, collapsed positions.

While preferred embodiments of the invention have been described herein, it should be apparent to those skilled in the art that variations and further modifications are possible without departing from the spirit of the invention.

It is claimed and desired to secure by Letters Patent:

1. A portable sign holder comprising an upright sign support, and a collapsible base to which said support is connected, said base including a bracket member adjacent the bottom of said sign support, at least a pair of elongate leg members pivotally connected adjacent an inner set of their ends to said bracket member adjacent said sign support for swinging relative to said bracket member and toward and away from said sign support about substantially horizontal pivot axes between support positions extending outwardly at substantial angles from said bracket member to opposite sides of said sign support and upwardly therefrom to collapsed positions extending upwardly from said bracket member adjacent opposite faces of said sign support, and releasable locking means for holding each of said leg members in one of said positions, the locking means and pivot connections between said leg and bracket members being so positioned that when said leg members are held in their support positions a leg member is disposed at a low angle to the horizontal with its outer end lower than its inner end, said locking means for a leg member including a pair of depressions formed in said bracket member spaced substantially equal distances radially outwardly from said pivot connection and spaced at greater than 90° from each other about said pivot connection, and an engaging member mounted on said leg member for engagement with one of said depressions when the leg member is in its support position and for engaging the other depression when the leg member is in its collapsed position, said engaging member comprising an elongate pin mounted on said leg member for shifting toward and away from said bracket member between locking and retracted positions, and yieldable biasing means for urging said pin toward said bracket member.

2. A portable sign holder comprising a sign support, a base member, resilient mounting means mounting said sign support on said base member in a generally upright position, said resilient mounting means permitting movement of said sign support from its generally upright position when a force is applied thereto and returning the sign support to said generally upright position when such force is removed, a pair of collapsible, elongate ground-engaging legs pivotally connected adjacent their inner set of ends to said base member for swinging relative to the base member and toward and away from said sign support about substantially horizontal axes between support positions extending outwardly from the base member to opposite sides of the sign support and upwardly therefrom to collapsed positions extending upwardly from the base member adjacent opposite faces of said sign support, and releasable locking means for holding each of said legs in one of said positions, the locking means and pivot connections between said leg and base members being so positioned that when said leg members are held in their support positions a leg member is disposed at a low angle to the horizontal with its outer end being lower than its inner end, said locking means for a leg member including a pair of depressions in said base member spaced substantially equal distances radially outwardly from said pivot connection and spaced at greater than 90° from each other about said pivot connection, and an engaging member mounted on said leg member for engagement with one of said depressions when the leg member is in its support position and for engaging the other depression when the leg member is in its collapsed position, said engaging member comprising an elongate pin mounted on said leg member for shifting toward and away from said base member between locking and retracted positions and yieldable biasing means for urging said pin toward said base member.

3. A portable sign holder comprising an upright sign support, and a collapsible base to which said support is connected, said base including a bracket member adjacent the bottom of said sign support, a pair of elongate leg members pivotally connected adjacent an inner set of their ends to said bracket member adjacent said sign support for swinging relative to said bracket member and said sign support about substantially horizontal pivot axes between support positions extending outwardly at substantial angles from said bracket member to opposite sides of said sign support and collapsed positions extending upwardly from said bracket member adjacent opposite faces of said sign support, and releasable locking means for holding each of said leg members in one of said positions, said locking means and pivot connections between said leg and bracket members being so positioned that when said leg members are held in their support positions a leg member is disposed at a low angle to the horizontal with its outer end lower than its inner end, said locking means for a leg member comprising a pair of depressions formed in said bracket member spaced substantially equal distances radially outwardly from said pivot connection and spaced at greater than 90° from each other about said pivot connection, and an engaging member mounted on said leg member for engagement with one of said depressions when the leg member is in its support position and for engaging the other depression when the leg member is in its collapsed position, said engaging member comprising an elongate pin mounted on said leg member for shifting toward and away from said bracket member between locking and retracted positions and positioned on the leg member to be received in a depression on the bracket member when the leg is in a support or collapsed position and said pin is in its locking position, yieldable biasing means for urging said pin toward said bracket member, and means for releasably holding said pin in said retracted position spaced from said bracket member.

4. The sign holder of claim 3, wherein said pin is rotatable about its longitudinal axis and said holding means comprises cooperating engaging means on said pin and leg member for retaining said pin in its retracted position when rotated to one position and permitting shifting of said pin toward said bracket member when rotated to another position.

5. A portable sign holder comprising an upright sign support, and a collapsible base to which said support is connected, said base including a bracket member adjacent the bottom of said sign support, a pair of elongate leg members pivotally connected adjacent an inner set of their ends to said bracket member adjacent said sign support for swinging relative to said bracket member and said sign support about substantially horizontal pivot axes between support positions extending outwardly at substantial angles from said bracket member to opposite sides of said sign support and collapsed positions extending upwardly from said bracket member adjacent opposite faces of said sign support, and releasable locking means for holding each of said leg members in one of said positions, said locking means and pivot connections between said leg and bracket members being so positioned that when said leg members are held in their support positions a leg member is disposed at a low angle to the horizontal with its outer end lower than its inner end, said locking means for a leg member comprising a pair of depressions formed in said bracket member spaced substantially equal distances radially outwardly from said pivot connection and spaced at greater than 90° from each other about said pivot connection, and an engaging member mounted on said leg member for engagement with one of said depressions when the leg member is in its support position and for engaging the other depression when the leg member is in its collapsed position, and said locking means further comprises a notch formed in a bracket member to which a leg member is pivotally connected and a locking bar mounted on said leg member for shifting toward and away from engagement with said notch.

6. A portable sign holder comprising a sign support, a base member, resilient mounting means mounting said sign support on said base member in a generally upright position, said resilient mounting means permitting movement of said sign support from its generally upright position when a force is applied thereto and returning the sign support to said generally upright position when such force is removed, and a pair of collapsible, elongate ground-engaging legs pivotally connected adjacent their inner set of ends to said base member for swinging relative to the base member about substantially horizontal axes between support positions extending outwardly from the base member to opposite sides of the sign support and collapsed positions extending upwardly from the base member adjacent opposite faces of said sign support, and releasable locking means for holding each of said legs in one of said positions, said locking means and pivot connections between said leg and base members being so positioned that when said leg members are held in their support positions a leg member is disposed at a low angle to the horizontal with its outer end being lower than its inner end, said locking means for a leg member comprising a pair of depressions in said base member spaced substantially equal distances radially outwardly from said pivot connection and spaced at greater than 90° from each other about said pivot connection, and an engaging member mounted on said leg member for engagement with one of said depressions when the leg member is in its support position and for engaging the other depression when the leg member is in its collapsed position, an engaging member comprising an elongate pin mounted on said leg member for shifting toward and away from said base member between locking and retracted positions and positioned on the leg member to be received in a depression on the base member when the leg is in a support or collapsed position and the pin is in its locking position, yieldable biasing means for urging said pin toward said base member, and means for releasably holding said pin in its retracted position spaced from said base member.

7. The sign holder of claim 6, wherein said pin is rotatable about its longitudinal axis and said holding means comprises cooperating engaging means on said pin and leg member for retaining said pin in its retracted position when rotated to one position and permitting shifting of said pin toward said base member when rotated to another position.

8. A portable sign holder comprising a sign support, a base member, resilient mounting means mounting said sign support on said base member in a generally upright position, said resilient mounting means permitting movement of said sign support from its generally upright position when a force is applied thereto and returning the sign support to said generally upright position when such force is removed, and a pair of collapsible, elongate ground-engaging legs pivotally connected adjacent their inner set of ends to said base member for swinging relative to the base member about substantially horizontal axes between support positions extending outwardly from the base member to opposite sides of the sign support and collapsed positions extending upwardly from the base member ajdacent opposite faces of said sign support, and releasable locking means for holding each of said legs in one of said positions, said locking means and pivot connections between said leg and base members being so positioned that when said leg members are held in their support positions a leg member is disposed at a low angle to the horizontal with its outer end being lower than its inner end, said locking means for a leg member comprising a pair of depressions in said base member spaced substantially equal distances radially outwardly from said pivot connection and spaced at greater than 90° from each other about said pivot connection, and an engaging member mounted on said leg member for engagement with one of said depressions when the leg member is in its support position and for engaging the other depression when the leg member is in its collapsed position, and said locking means further comprises a notch formed in a base member to which a leg member is pivotally connected and a locking bar mounted on said leg member for shifting toward and away from engagement with said notch.

9. A portable sign holder comprising an upright sign support, and a collapsible base to which said support is connected, said base including a bracket member adjacent the bottom of said sign support, a pair of elongate leg members pivotally connected adjacent an inner set of their ends to said bracket member adjacent said sign support for swinging relative to said bracket member and said sign support about substantially horizontal pivot axes between support positions extending outwardly at substantial angles from said bracket member to opposite sides of said sign support and collapsed positions extending upwardly from said bracket member adjacent opposite faces of said sign support, and releasable locking means for holding each of said leg members in one of said positions including a pair of spaced depressions formed in said bracket member and an engaging member mounted on said leg member for engagement with one of said depressions when the leg member is in its support position and for engaging the other depression when the leg member is in its collapsed position, said engaging member comprising an elongate pin mounted on said leg member for shifting toward and away from said bracket member between locking and retracted positions and positioned on the leg member to be received in a depression on the bracket member when the leg is in a support or collapsed position and said pin is in its locking position, yieldable biasing means for urging said pin toward said bracket member, and means for releasably holding said pin in said retracted position spaced from said bracket member.

10. A portable sign holder comprising an upright sign support, and a collapsible base to which said support is connected, said base including a bracket member adjacent the bottom of said sign support, a pair of elongate leg members pivotally connected adjacent an inner set of their ends to said bracket member adjacent said sign support for swinging relative to said bracket member and said sign support about substantially horizontal pivot axes between support positions extending outwardly at substantial angles from said bracket member to opposite sides of said sign support and collapsed positions extending upwardly from said bracket member adjacent opposite faces of said sign support, and releasable locking means for holding each of said leg members in one of said positions, said locking means and pivot connections between said leg and bracket members being so positioned that when said leg members are held in their support positions a leg member is diposed at a low angle to the horizontal with its outer end lower than its inner end, said locking means for a leg member comprising a pair of depressions formed in said bracket member spaced substantially equal distances radially outwardly from said pivot connection and spaced at greater than 90° from each other about said pivot connection, and an engaging member mounted on said leg member for engagement with one of said depressions when the leg member is in its support position and for engaging the other depression when the leg member is in its collapsed position, said engaging member comprising a projection extending from said leg member toward said bracket member, said bracket member and leg member being pivotally connected by an elongate pivot pin projecting from one of said members and through the other of said members, with said members being shiftable toward and away from each other longitudinally along said pin, and which further comprises biasing means yieldably urging said leg and bracket members toward each other longitudinally of said pin.

11. A portable sign holder comprising a sign support, a base member, resilient mounting means mounting said sign support on said base member in a generally upright position, said resilient mounting means permitting movement of said sign support from its generally upright position when a force is applied thereto and returning the sign support to said generally upright position when such force is removed, and a pair of collapsible, elongate ground-engaging legs pivotally connected adjacent their inner set of ends to said base member for swinging relative to the base member about substantially horizontal axes between support positions extending outwardly from the base member to opposite sides of the sign support and collapsed positions extending upwardly from the base member adjacent opposite faces of said sign support, and releasable locking means for holding each of said legs in one of said positions, said locking means and pivot connections between said leg and base members being so positioned that when said leg members are held in their support positions a leg member is disposed at a low angle to the horizontal with its outer end being lower than its inner end, said locking means for a leg member comprising a pair of depressions in said base member spaced substantially equal distances radially outwardly from said pivot connection and spaced at greater than 90° from each other about said pivot connection, and an engaging member mounted on said leg member for engagement with one of said depressions when the leg member is in its support position and for engaging the other depression when the leg member is in its collapsed position, said engaging member comprising a projection extending from said leg member toward said base member, said base member and leg member being connected by an elongate pivot pin projecting from one of said members and through the other of said members, with said members being shiftable toward and away from each other longitudinally along said pin, and which further comprises biasing means yieldably urging said leg and base members toward each other longitudinally along said pin.

* * * * *